US008597235B2

(12) United States Patent
Lo

(10) Patent No.: US 8,597,235 B2
(45) Date of Patent: Dec. 3, 2013

(54) FEEDING APPARATUS

(75) Inventor: Fu Man Herman Lo, Hong Kong (HK)

(73) Assignee: Dongguan Kidsme Trading Company Limited, Dongguan (CN)

( * ) Notice: Subject to any disclaimer, the term of this patent is extended or adjusted under 35 U.S.C. 154(b) by 452 days.

(21) Appl. No.: 12/713,179

(22) Filed: Feb. 26, 2010

(65) Prior Publication Data

US 2010/0230373 A1 Sep. 16, 2010

(30) Foreign Application Priority Data

Mar. 10, 2009 (CN) ..... 2009 2 0135477
Jul. 22, 2009 (CN) ..... 2009 2 0306690
Nov. 4, 2009 (CN) ..... 2009 2 0314008

(51) Int. Cl.
*A61J 9/00* (2006.01)
*A61J 11/00* (2006.01)

(52) U.S. Cl.
USPC ..... 604/77; 215/11.1; 606/236

(58) Field of Classification Search
USPC ..... 215/11.1; 606/236; 604/77
See application file for complete search history.

(56) References Cited

U.S. PATENT DOCUMENTS 1,408,520 A * 3/1922 Larsen ..... 401/28
2,426,927 A * 9/1947 Ganson ..... 215/11.5
3,093,256 A * 6/1963 Woodbury, Jr. ..... 215/11.1
3,129,709 A * 4/1964 Rountree ..... 606/236
3,273,703 A * 9/1966 Stribley ..... 206/471
3,549,036 A * 12/1970 Ritsi ..... 215/11.6
3,610,248 A 10/1971 Davidson
3,742,950 A 7/1973 Endrody
3,762,542 A * 10/1973 Grimes ..... 206/525
4,623,069 A 11/1986 White
4,765,497 A * 8/1988 Hsu ..... 215/11.1
4,856,995 A * 8/1989 Wagner ..... 433/215
4,946,054 A * 8/1990 Maniero et al. ..... 215/11.6
5,078,734 A 1/1992 Noble
5,123,915 A * 6/1992 Miller et al. ..... 606/234
5,395,392 A 3/1995 Suhonen (Continued)

FOREIGN PATENT DOCUMENTS

CN 2735981 10/2005
CN 201108607 9/2008

(Continued)

OTHER PUBLICATIONS

Search Report and Written Opinion of PCT patent application No. PCT/CN/2010/000724.

(Continued)

*Primary Examiner* — Tri Mai

(57) ABSTRACT

A feeding apparatus includes a food container having an open end and a closed end. A plurality of apertures is formed on the container. A first coupling member has an opening in communication with the container open end. A second coupling member cooperates with the first coupling member and movable between an open configuration allowing food to pass through the opening and into the container, and a sealed configuration where the second coupling member covers and seals the open end of the container. The container is made of a soft resilient material, and the apertures and the container are sized and shaped such that normally the container stays in its original shape and the food stays inside the container. The container collapses by external force during feeding, and returns to its original shape upon release of the force.

7 Claims, 16 Drawing Sheets

(56) References Cited

U.S. PATENT DOCUMENTS

| | | | | |
|---|---|---|---|---|
| 5,419,445 | A * | 5/1995 | Kaesemeyer | 215/11.1 |
| 5,462,101 | A | 10/1995 | Mouchmouchian | |
| 5,578,004 | A | 11/1996 | Liang | |
| 5,711,759 | A * | 1/1998 | Smith et al. | 601/139 |
| 6,110,193 | A * | 8/2000 | Chen | 606/234 |
| 6,524,272 | B1 * | 2/2003 | Berry, Sr. | 604/77 |
| 6,547,808 | B2 * | 4/2003 | Tuckey et al. | 606/234 |
| 2003/0018359 | A1 * | 1/2003 | Tuckey et al. | 606/236 |
| 2003/0236556 | A1 | 12/2003 | Dickerson | |
| 2005/0284835 | A1 * | 12/2005 | McKendry et al. | 215/11.1 |
| 2006/0065232 | A1 * | 3/2006 | Wurtz et al. | 123/204 |
| 2006/0144810 | A1 * | 7/2006 | Mallet | 215/11.1 |
| 2007/0021782 | A1 | 1/2007 | Inoue et al. | |
| 2007/0203450 | A1 | 8/2007 | Berry | |
| 2007/0221604 | A1 | 9/2007 | Hakim | |
| 2008/0177305 | A1 | 7/2008 | Vath et al. | |
| 2008/0319479 | A1 | 12/2008 | Murphy Matro | |

FOREIGN PATENT DOCUMENTS

| | | |
|---|---|---|
| CN | 201275285 | 7/2009 |
| EP | 1113776 | 7/2001 |
| EP | 1275366 | 1/2003 |
| ES | 258262 | 11/1981 |
| ES | 1055586 | 12/2003 |
| ES | 1064926 | 5/2007 |
| ES | 1067041 | 4/2008 |
| ES | 1067973 | 8/2008 |
| GB | 536196 | 5/1941 |
| JP | S56109746 U | 8/1981 |
| JP | 05-041549 | 6/1993 |
| JP | 06-005637 | 1/1994 |
| JP | 3105120 | 10/2004 |
| TW | 202592 | 3/1993 |
| TW | 333831 | 6/1998 |
| TW | 556554 | 10/2003 |
| WO | 85/04573 | 10/1985 |
| WO | 20031086266 | 10/2003 |

OTHER PUBLICATIONS

Search Report and Written Opinion of PCT patent application No. PCT/CN2010/070940.
Search Report and Written Opinion of PCT patent application No. PCT/CN2010/070745.
UK Search Report of patent application No. GB1003137.5.
Search Report of Hong Kong Short-term patent application.
Notification of Final Refusal for Spanish Utility Model Application No. 201030208.
English translation of the Summary of the Notification of Final Refusal for Spanish Utility Model Application No. 201030208.
Notification of Opposition Proceedings of the Spanish Utility Model Application No. 201030208.
English translation of the Summary of Notification of Opposition Proceedings of the Spanish Utility Model Application No. 201030208.
Opposition filed against Spanish Utility Model Application No. 201030208.
Examination Report of British Patent Application No. GB1003137.5.
UK Search Report of patent application No. GB1008313.7.
Supplementary Search Report issued by the European Patent Office for EP10750332.
First Office Action of Korean Patent Application No. 10-2010-0067079.
English translation of the first Office Action of Korean Patent Application No. 10-2010-0067079.
Examination Report by the European Patent Office for the European Patent Application No. 10801844.1.
Office Action issued by the Taiwanese Patent Office on Dec. 18, 2012 for the Taiwanese patent application No. 099116079.

* cited by examiner

FEEDING APPARATUS

CROSS-REFERENCE TO RELATED APPLICATIONS

This application claims priorities of Chinese Patent Application No. 200920135477.5, filed on Mar. 10, 2009, Chinese Patent Application No. 200920306690.8, file on Jul. 22, 2009, and Chinese Patent Application No. 200920314008.X, file on Nov. 4, 2009, the entire contents of which are hereby incorporated by reference.

FIELD OF PATENT APPLICATION

The present application relates to a feeding apparatus.

BACKGROUND

Milk bottles are used to contain liquid state food such as milk and beverage for feeding infants. However, there is no suitable feeding apparatus to hold small pieces of cut fruit such as pear, apple and vegetable for feeding infants. There is a need to provide a feeding apparatus that can be used to feed infants with food such as fruit, jelly, yogurt, fish, meat, etc.

SUMMARY

According to one aspect, there is provided a feeding apparatus including:

a food container including an open, a closed end, and at least one aperture;

a first coupling member having an opening in communication with the container open end, the food container being engaged with the first coupling member; and a second coupling member cooperating with the first coupling member and movable between an open configuration allowing food to pass through the opening and into the food container, and a sealed configuration where the second coupling member covers the opening of the first coupling member thereby sealing the open end of the food container;

wherein the food container is made of a soft resilient material, and the at least one aperture and the food container are sized and shaped such that normally the food container stays in its original shape and the food stays inside the food container, and wherein the food container while in a person's mouth collapses by external force that forces the food to pass through the at least one aperture, and the food container returns to its original shape upon release of the force.

In one embodiment, the soft resilient material is silicone, latex or rubber suitable for use with foodstuff.

In one embodiment, a protrusion is formed around each aperture on an outer surface of the food container.

In one embodiment, the outer surface of the protrusion is generally in the shape of a truncated dome.

In one embodiment, the feeding apparatus further includes at least one fastening mechanism for fastening the first and second coupling members together while in the sealed configuration.

In one embodiment, the first and second coupling members are fastened together by screw threads or fasteners.

In one embodiment, the first and second coupling members are hingedly connected together at one side and fastened together at the other side.

In one embodiment, the first and second coupling members are fastened together at two sides thereof by two fasteners respectively.

In one embodiment, the open end of the food container, the outer surfaces of the first and second coupling members are generally circular in shape.

In one embodiment, the food container is generally in the shape of a nipple of a milk-feeding bottle.

In one embodiment, the shape of the closed end of the food container generally conforms to the shape of the mouth of an infant.

In one embodiment, the feeding apparatus further includes a cap for covering the food container.

In one embodiment, the open end of the food container includes an annular flange which is adapted to be clamped between an annular platform of the first coupling member and the second coupling member while in the sealed configuration.

In one embodiment, the feeding apparatus further includes a position-fixing mechanism, wherein the position of the annular flange relative to the annular platform is fixed by the position-fixing mechanism so that a person's hand is substantially horizontal when the food container is in the person's mouth.

In one embodiment, the position-fixing mechanism includes a notch formed on the annular flange and a corresponding projection formed on the annular platform.

In one embodiment, the handle assembly comprises a handle core, a handle pad and a handle sleeve, the handle core being connected to the second coupling member, the handle pad being fixed to the handle core, and the handle sleeve being wrapped around the handle pad.

In one embodiment, the at least one aperture is circular in shape and has a diameter of about 1 mm to about 5 mm.

In one embodiment, the distance between two adjacent apertures is about 2 mm to about 10 mm.

In one embodiment, the food container of the feeding apparatus includes a plurality of apertures.

In one embodiment, the apertures are arranged 360 degrees around the food container.

In one embodiment, the feeding apparatus further includes a plurality of projections formed on the outer surface of the food container.

Although the feeding apparatus disclosed in the present application is shown and described with respect to certain embodiments, it is obvious that equivalents and modifications will occur to others skilled in the art upon the reading and understanding of the specification. The present application includes all such equivalents and modifications, and is limited only by the scope of the claims.

BRIEF DESCRIPTION OF THE DRAWINGS

Specific embodiments of the feeding apparatus disclosed in the present application will now be described by way of example with reference to the accompanying drawings wherein.

DETAILED DESCRIPTION

Reference will now be made in detail to a preferred embodiment of the feeding apparatus disclosed in the present application, examples of which are also provided in the following description. Exemplary embodiments of the feeding apparatus disclosed in the present application are described in detail, although it will be apparent to those skilled in the relevant art that some features that are not particularly important to an understanding of the feeding apparatus may not be shown for the sake of clarity.

Furthermore, it should be understood that the feeding apparatus disclosed in the present application is not limited to the precise embodiments described below and that various changes and modifications thereof may be effected by one skilled in the art without departing from the spirit or scope of the appended claims. For example, elements and/or features of different illustrative embodiments may be combined with each other and/or substituted for each other within the scope of this disclosure and appended claims.

It should be noted that throughout the specification and claims herein, when one element is said to be "coupled" or "connected" to another, this does not necessarily mean that one element is fastened, secured, or otherwise attached to another element. Instead, the term "coupled" or "connected" means that one element is either connected directly or indirectly to another element, or is in mechanical or electrical communication with another element.

Figure 1:
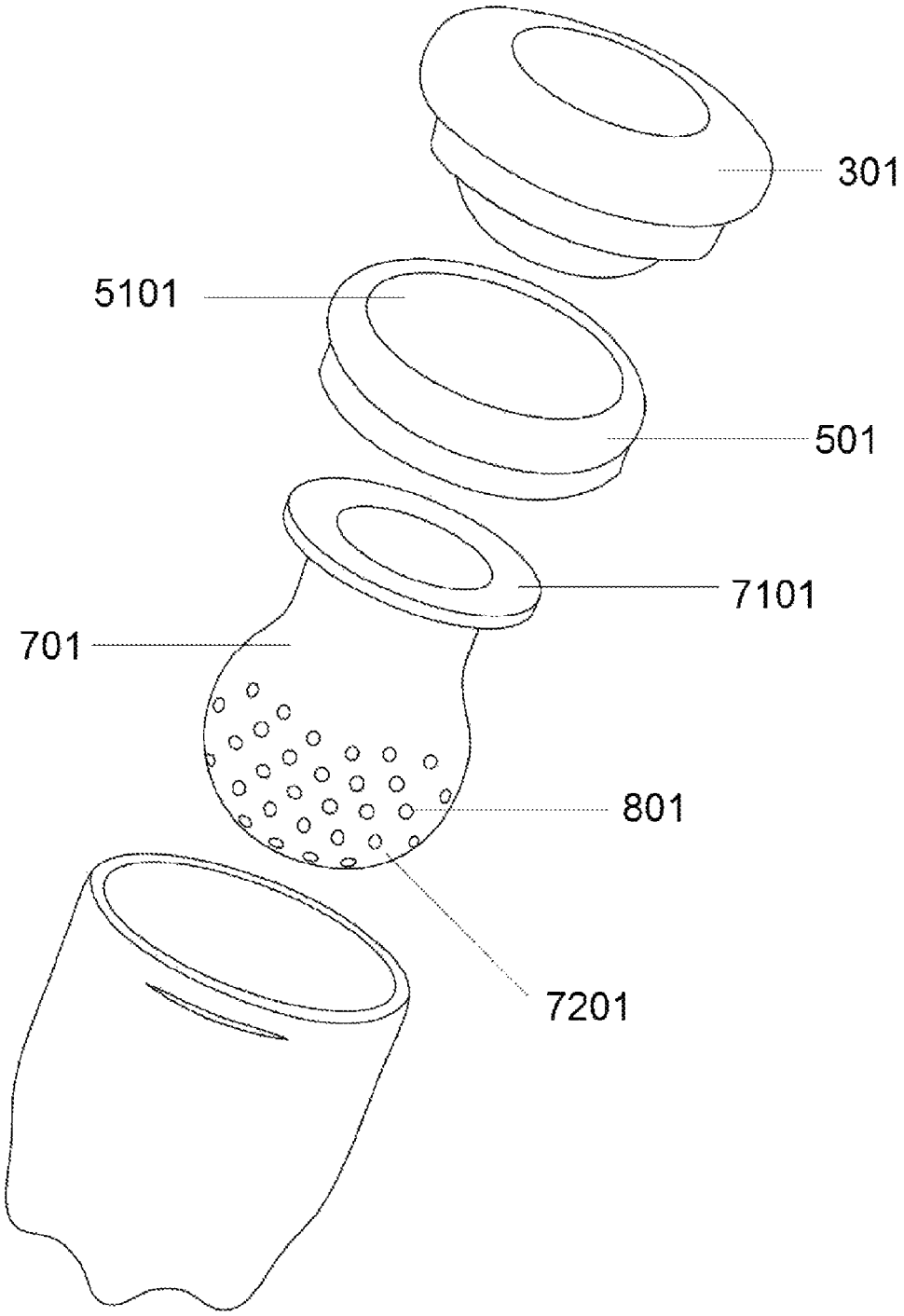
FIG. 1 is an exploded view of a first embodiment of the feeding apparatus.

FIG. 1 is an exploded view of a first embodiment of the feeding apparatus. The apparatus includes a food container 701, a first coupling member 501, and a second coupling member 301. The food container 701 has an open end 7101 and a closed end 7201. The first coupling member 501 includes an opening 5101. The food container 701 can be removably engaged with the first coupling member 501. When the food container 701 is coupled to the first coupling member 501, the open end 7101 of the food container 701 is in communication with the opening 5101 of the first coupling member 501. Food can be put into the food container 701 through the opening 5101 of the first coupling member and the open end 7101 of the food container 701. The second coupling member 301 can be cooperating with the first coupling member 501 and movable between an open configuration and a sealed configuration. In the open configuration, food can be put into the food container 701 through the opening 5101 of the first coupling member 501 and the open end 7101 of the food container 701. In the sealed configuration, the second coupling member 301 covers the opening 5101 of the first coupling member 501 thereby sealing the open end 7101 of the food container 701.

The food container 701 is provided with at least one aperture 801. According to the illustrated embodiment, the food container 701 has a plurality of apertures 801 arranged 360 degrees around the food container 701. The size and shape of the apertures 801 can be so designed that food coming out from the apertures 801 would not choke a person consuming the food. According to the illustrated embodiments, the apertures 801 are circular in shape and can have a diameter of about 1 mm to about 5 mm. The size, number and arrangement of the apertures 801 may vary according to different designs and requirements.

The food container 701 may be made of a soft resilient material suitable for use with foodstuff. This soft resilient material for foodstuff use may include silicone or latex, or rubber or polyvinyl chloride (PVC) for foodstuff use. Silicone material is non-toxic, environmental-friendly, wear resistant, resistant to high and low temperatures, and aging resistant. Products made of silicone are more environmental-friendly, more safe and more durable. It is appreciated that the food container 701 can be made of a transparent soft resilient material allowing a person to readily see through the food container 701 and know whether the container 701 is full or empty.

Normally, the food container 701 stays in its original shape and the food stays inside the food container 701. When the food container 701 is put inside a person's mouth and a person chews, bites or sucks on the food container 701, the food container 701 collapses by the external force that forces the food (such as small pieces of crushed food, fruit puree, marc, juice, etc.) to seep and pass through the apertures 801. The food container 701 returns to its original shape upon release of the force due to the resiliency of the food container 701.

The food container 701 may be sized and shaped to hold small pieces of fruit or other food such as jelly, yogurt, vegetable, meat or fish, etc. The food container 701 can be put inside the mouth of a person for biting, sucking or chewing. For a fruit having juice and marc, fruit juice and small pieces of marc can be sucked through the apertures 801 and into a person's mouth, whilst larger pieces of marc remain inside the food container 701. Since the apertures 801 are smaller than the esophagus of a person eating the food, the person will not be choked by the food coming out from the apertures 801. This can protect the safety of the person eating food out of the feeding apparatus. For fruit having puree but without marc, the fruit puree can be dispensed through the apertures 801 and into the person's mouth. Therefore, one can use the feeding apparatus to feed an infant or baby with food such a fruit, and teach an infant or baby to chew and swallow without the risk of being choked by the fruit. The feeding apparatus is safe to an infant or baby and is convenient to use because it is not necessary for a caretaker to squeeze juice from the fruit before feeding. Using the feeding apparatus, an infant or baby can readily eat fresh fruit (such as strawberry, apple and pear), vegetable, fish, meat, etc.

When the food container 701 contains a mixture of food in solid state and liquid state, the liquid can form a sealing membrane over the apertures 801 under the influence of surface tension. Therefore, food inside the container 701 cannot be easily escaped through the apertures 801. An infant or baby needs to perform a suck action to suck the food through the apertures 801. This can train the muscles around the mouth as well as train the lung capacity of an infant or baby. Also, it can prevent leakage of liquid through the apertures 801 and spoilage of the clothing of the person eating the food out of the feeding apparatus. If the food container 701 is made of a mesh, the apertures on the mesh are not resilient and therefore it is difficult to form a sealing membrane over the apertures of the mesh. As the apertures on the mesh are close to each other, it becomes more difficult to form a sealing membrane over the mesh's apertures. The distance between two apertures 801 in the present application can be about 2 mm to about 10 mm.

As shown in FIG. 1, the first coupling member 501 and the second coupling member 301 may be coupled together. For example, the first coupling member 501 may be provided with an annular recess and the second coupling member 301 may be provided with an annular projection. A sealing configuration can be formed when the annular projection is pressed into the annular recess. An open configuration can be formed when the annular projection is pulled out from the annular recess. Of course, the first coupling member 5 and the second coupling member 301 can be coupled together by other suitable coupling mechanism such as screw threads.

Figure 2:
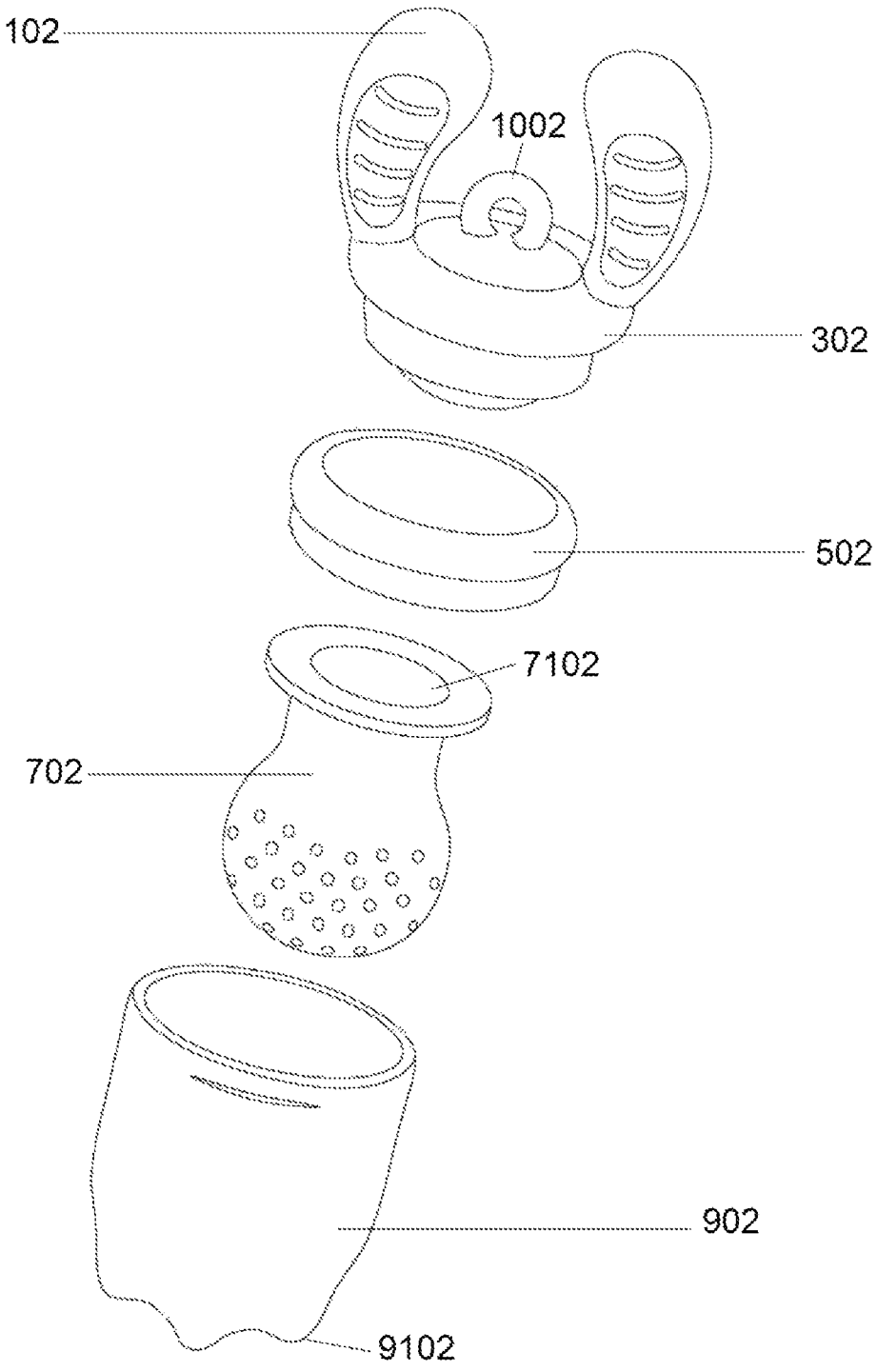
FIG. 2 is an exploded view of a second embodiment of the feeding apparatus.

As shown in FIG. 2, the feeding apparatus may further be provided with a handle assembly 102 which is connected to the second coupling member 302. This facilitates the grasping of the feeding apparatus by a person eating the food. This can promote the training of the muscles of the hands of a person, especially for babies and patients, and can promote his or her hand, brain and mouth coordination. This feeding apparatus design can realize the food-eating initiative of an infant or baby.

The feeding apparatus may also include a cap 902 for covering the food container 702. The cap 902 serves to separate the food from the outer environment. The cap 902 can prevent any dust and dirt from contaminating the food while a person is not eating. The cap 902 may be removably attached to the first coupling member 502. As shown in the illustrated embodiment, the cap 902 can be attached to the first coupling member 502 by a simple snap-fitting mechanism. It is understood that the cap 902 may be attached to the first coupling member 502 by any other appropriate mechanism such as screw threads. The closed end of the cap 902 may be provided with a plurality of supporting elements 9102. The supporting elements 9102 allow the cap 902 to steadily stand on a flat surface such as a desk. To fill the food container 702 with food, one can attach the cap 902 to the first coupling member 502, and then place the cap 902 on a desk in a stand-up position by the supporting elements 902. This facilitates the filling of the food container 702 with food even with one hand. The cap 902 may also be transparent and allow one to see the food inside the food container 702.

As illustrated in FIG. 2, the feeding apparatus may be provided with a rope-attaching element 1002 by which a rope can be tied. The rope-attaching element 1002 may be generally in the form of a ring integrally formed on the second coupling member 302. The rope-attaching element 1002 may be made of a hard plastic material or any other suitable material. A rope can be tied or threaded through the rope-attaching element 1002 so that the feeding apparatus can be hung around a person. This prevents the feeding apparatus from accidentally dropping on the ground and contaminating the food.

The food container 702 may be formed into the shape of a nipple of a milk-feeding bottle. It serves as a pacifier to comfort an infant or baby and induces the infant or baby to eat the food. The closed end of the food container 702 may be formed into a shape substantially conforming to the shape of the mouth of an infant or baby. This facilitates the infant in holding the food container 702 inside the mouth, and sucking fruit juice, puree or marc out of the food container 702 without choking.

According to the illustrated embodiment, the open end 7102 of the food container 702, the outer surfaces of the first coupling member 502 and the second coupling member 302 are generally circular in shape. This prevents the trapping of dirt on the feeding apparatus and facilitates cleaning of the feeding apparatus.

The feeding apparatus may also be provided with a fastening mechanism for fastening the first and second coupling members 502, 302 of the feeding apparatus in the sealed configuration. The fastening mechanism can strengthen the sealing between the first and second coupling members 502, 302 and prevent accidentally detaching the first coupling member 502 from the second coupling member 302 and therefore dropping the food.

Figure 3:
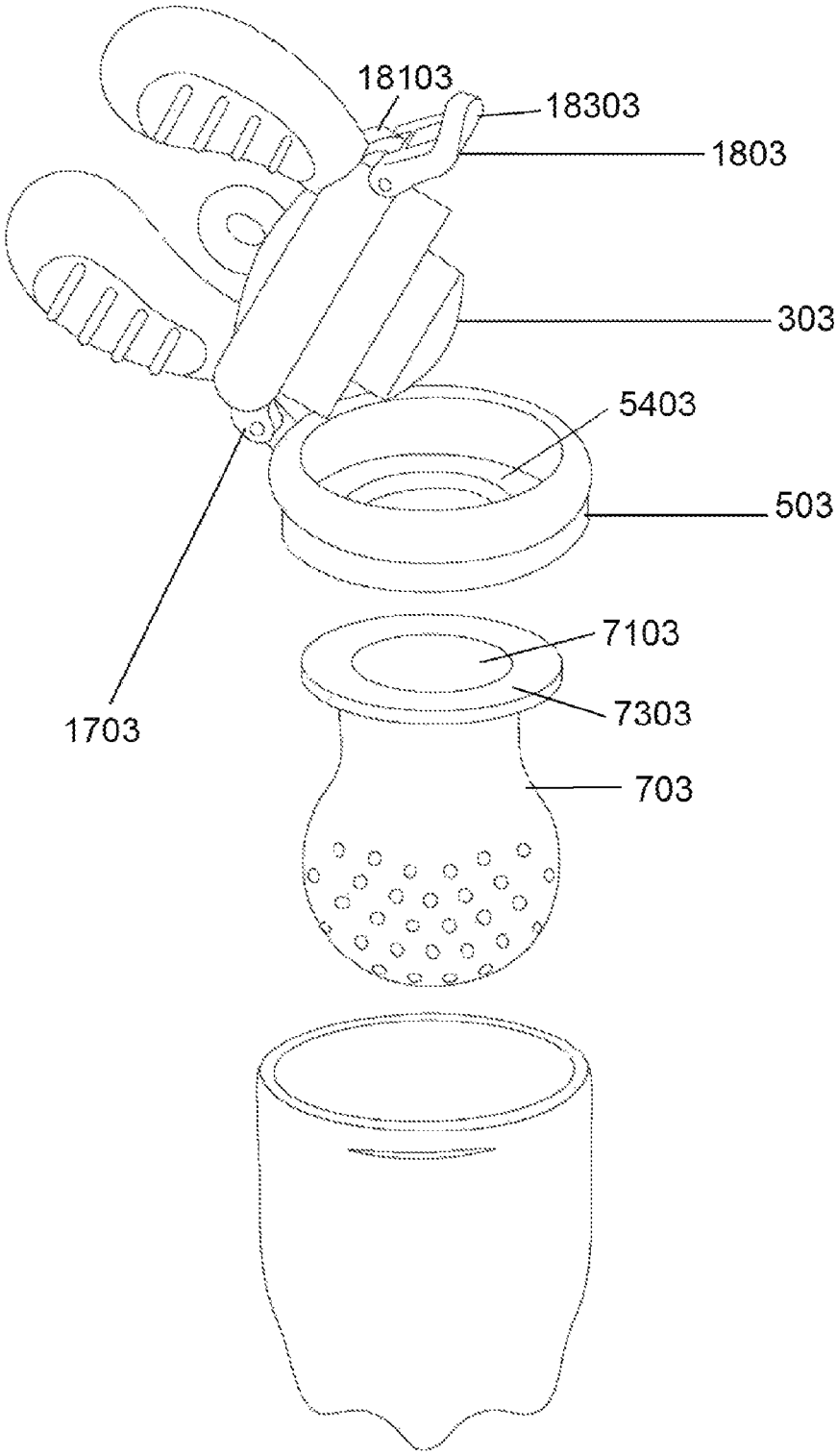
FIG. 3 is an exploded view of a third embodiment of the feeding apparatus.
Figure 4:
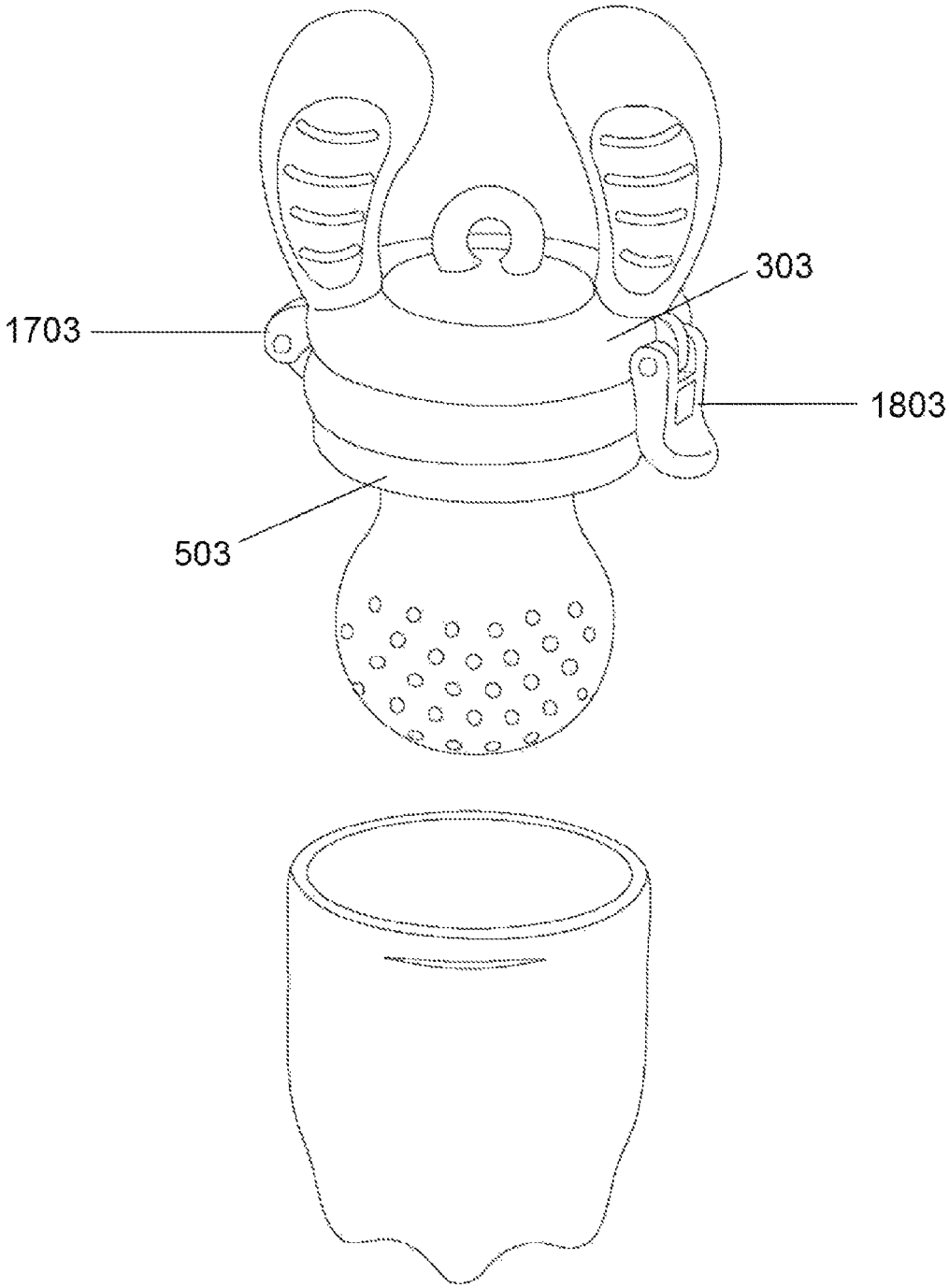
FIG. 4 is a perspective view of the third embodiment of the feeding apparatus.

According to the illustrated embodiment in FIGS. 3 and 4, the fastening mechanism may include a hinge 1703 and a fastener 1803. One side of the first and second coupling members 503, 303 can be hingedly connected to each other by the hinge 1703. The other side of the first and second coupling members 503, 303 can be secured together by the fastening 1803. One end 18103 of the fastener 1803 can be movably connected to the second coupling member 303. The other end 18303 of the fastener 1803 may include a fastening hole for frictional engagement with a corresponding fastening projection integrally formed on the first coupling member 503. It is contemplated that the hinge 1703 and the fastener 1803 are simple in construction, and can make opening and closing of the first and second coupling members 503, 303 easy.

Figure 5:
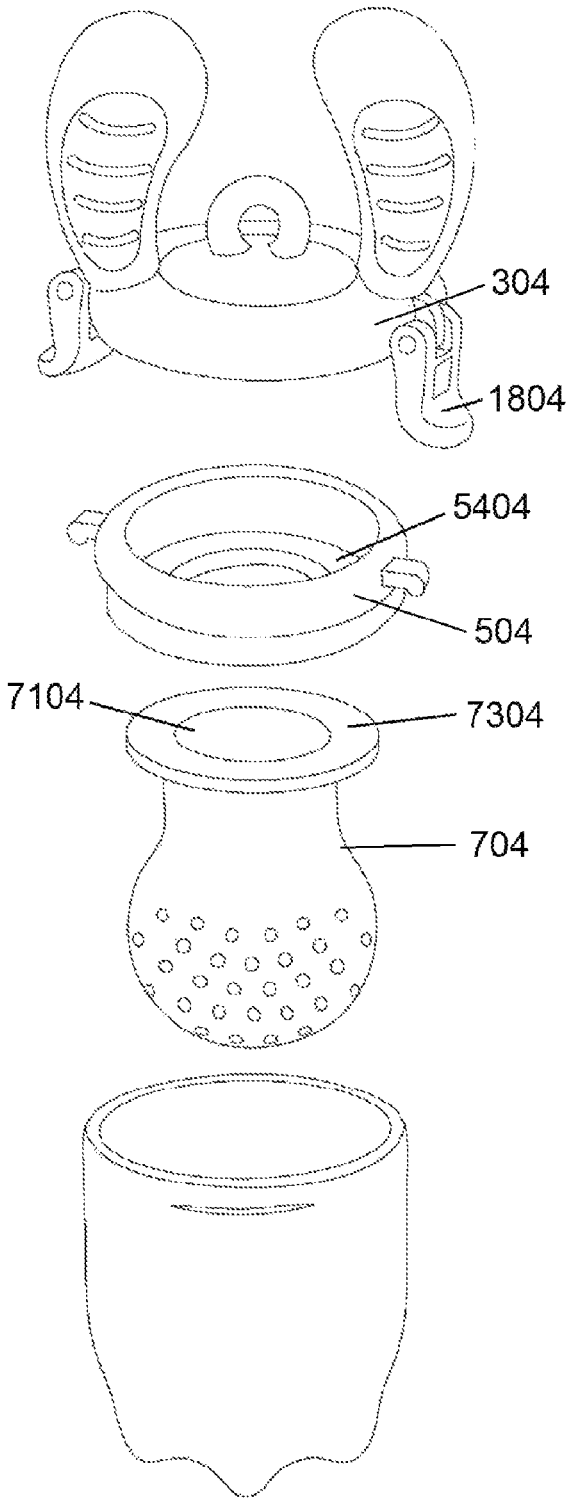
FIG. 5 is a partially exploded view of a fourth embodiment of the feeding apparatus.
Figure 6:
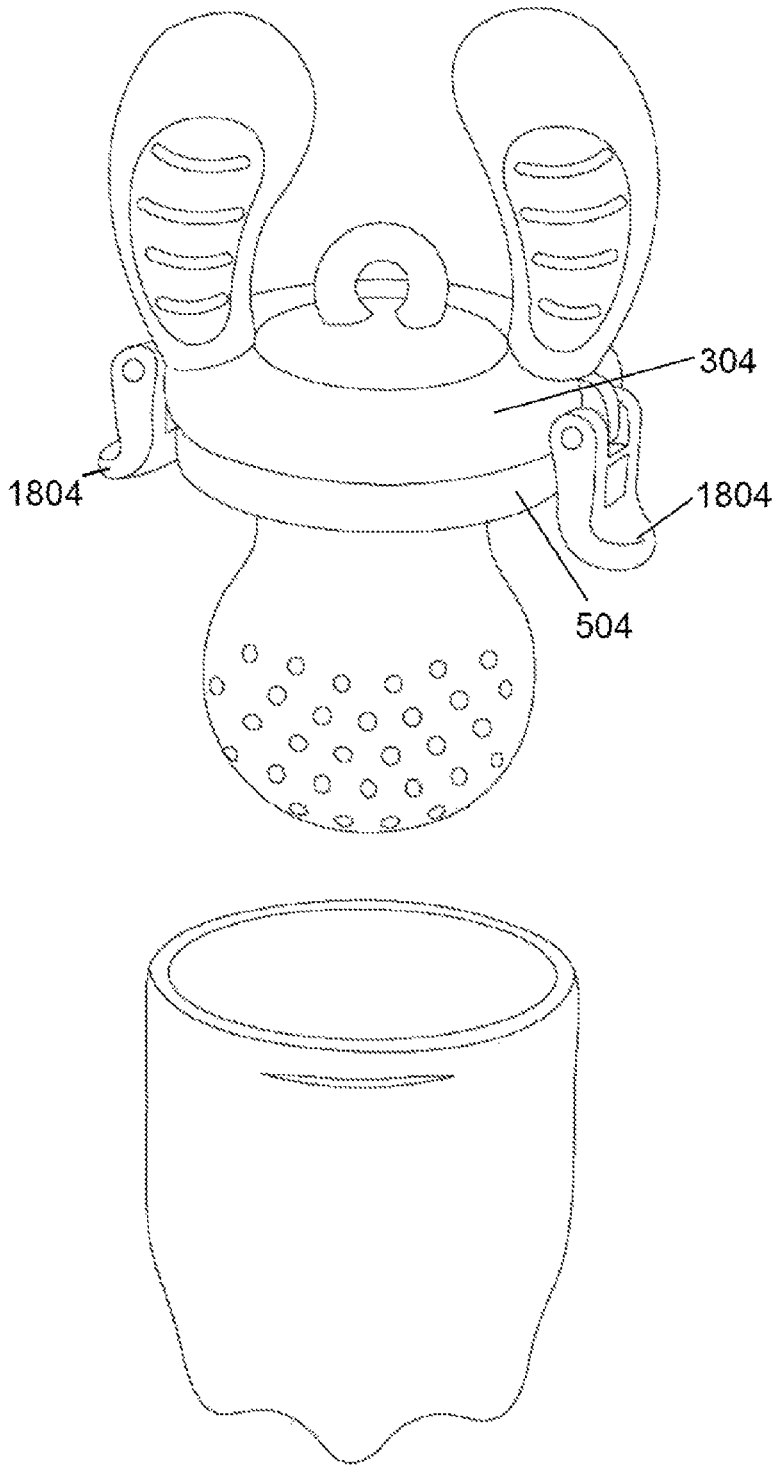
FIG. 6 is a perspective view of the fourth embodiment of the feeding apparatus.
Figures 7, 7A, 7B:
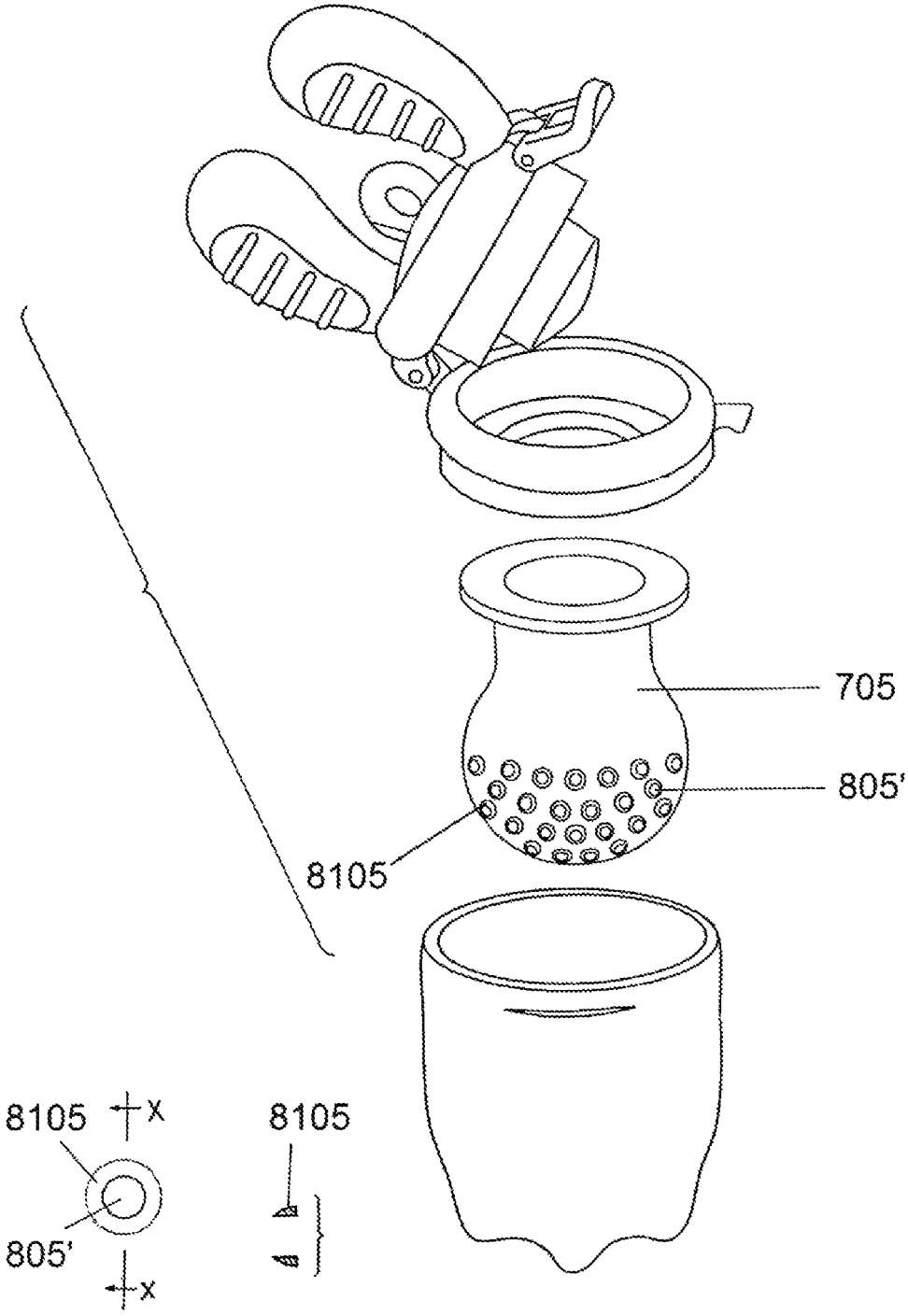
FIG. 7 is a partially exploded view of a fifth embodiment of the feeding apparatus.
FIG. 7*a* is a top view of an annular projection provided on the feeding apparatus.
FIG. 7*b* is a cross sectional view taken along line X-X of the annular projection in FIG. 7*a;*
Figure 8:
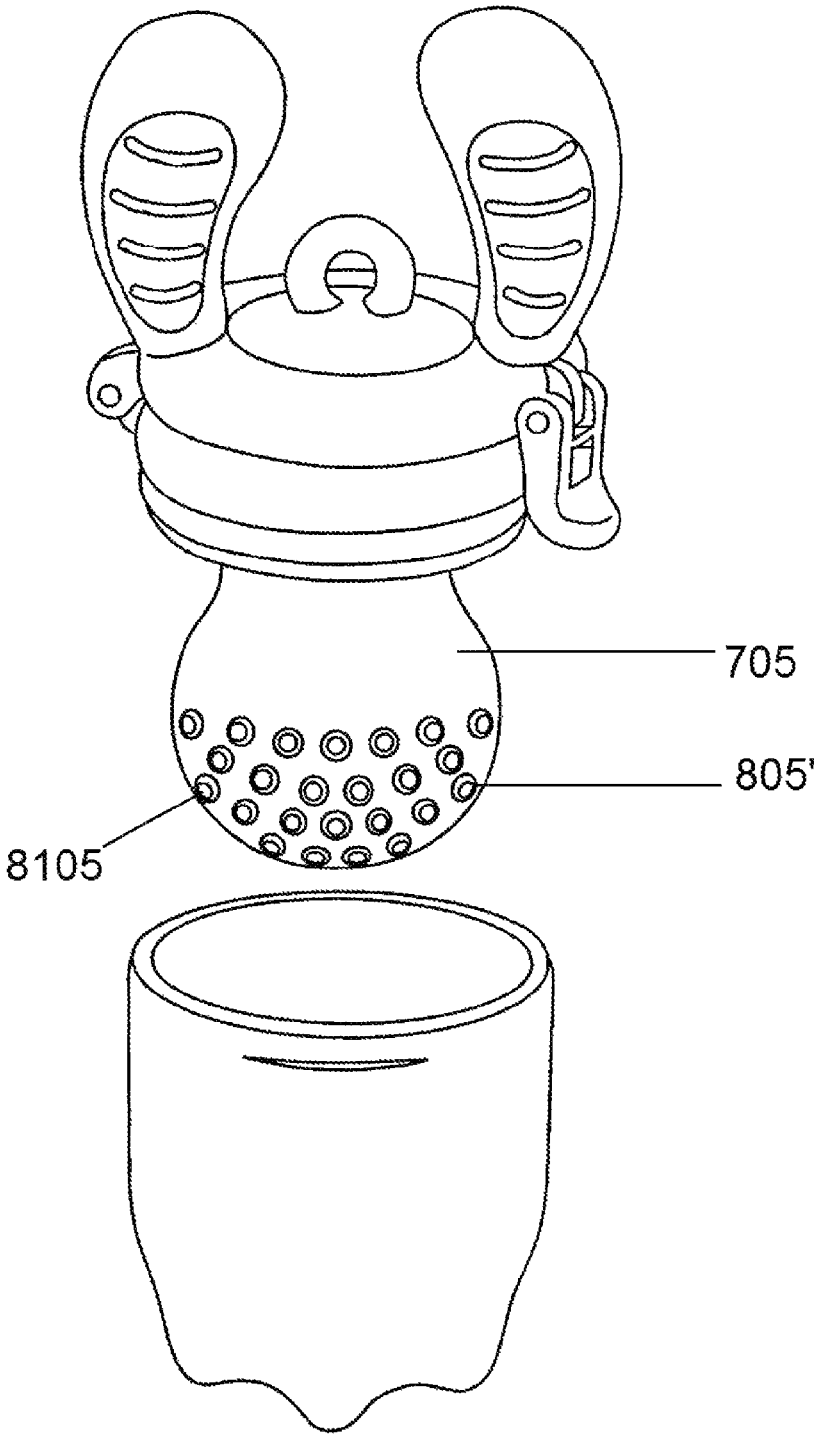
FIG. 8 is a perspective view of the fifth embodiment of the feeding apparatus.

According to another embodiment illustrated in FIGS. 5 and 6, the fastening mechanism may include two fasteners 1804. The two sides of the first and second coupling members 504, 304 can be secured together by the two fasteners 1804 respectively.

As depicted in FIGS. 7, 7*a*, 7*b* and 8, an annular protrusion 8105 may be integrally formed on the outer surface around of the aperture 805'. The protrusion 8105 can be used to massage the gum, relief discomfort during teething, benefit the growth and development of gum and teeth of an infant or baby. The protrusions 8105 can also strengthen the gum and enhance chewing capability. One can put an infant or baby's favorite food inside the food container 705. Infant or baby would like to eat the food and have the gum massaged while eating the food. The feeding apparatus with protrusions 8105 can therefore serve as a more effective teether compared to conventional tasteless teething apparatus.

Figure 9:
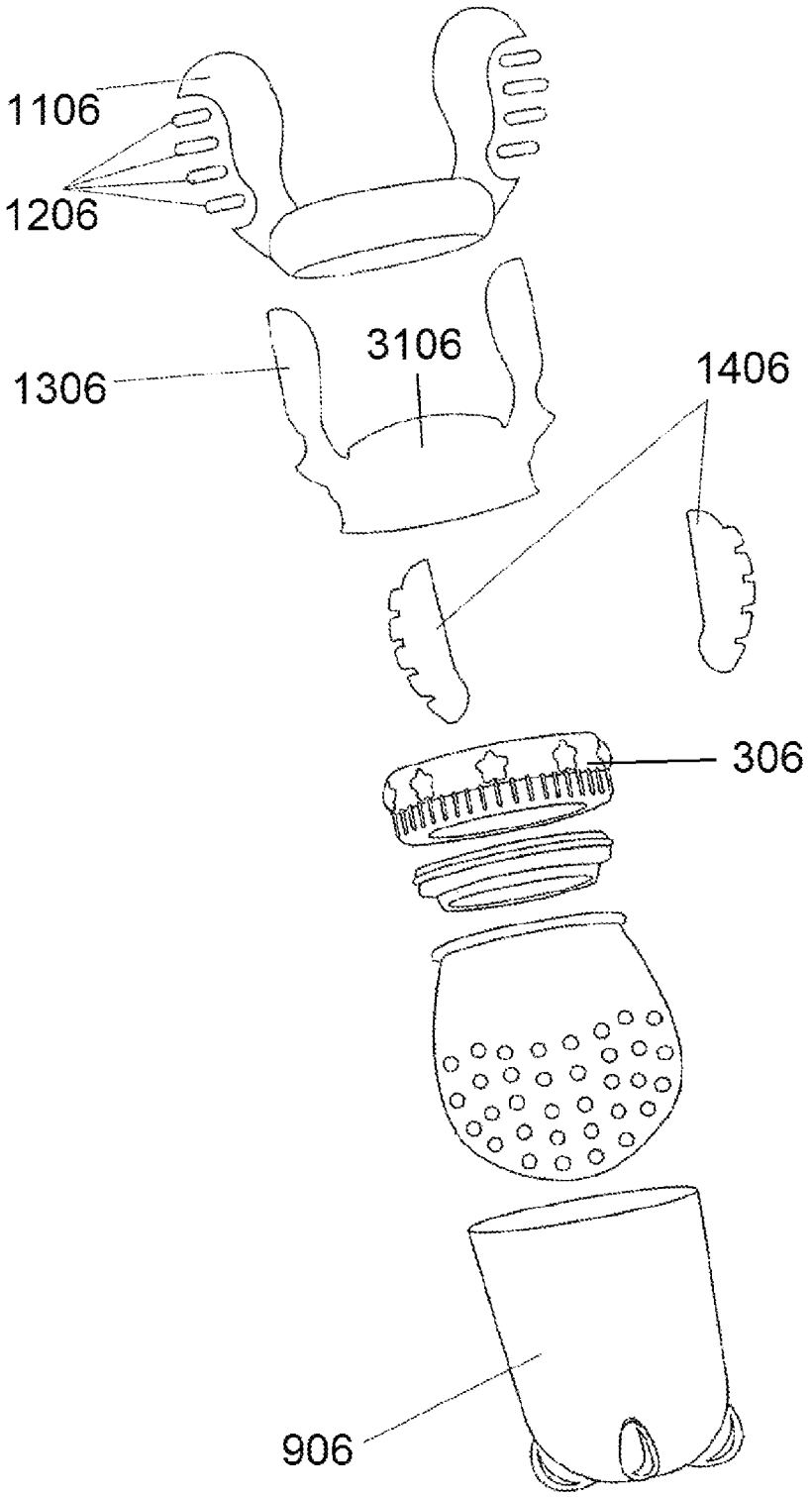
FIG. 9 is a partially exploded view of a sixth embodiment of the feeding apparatus.
Figure 10:
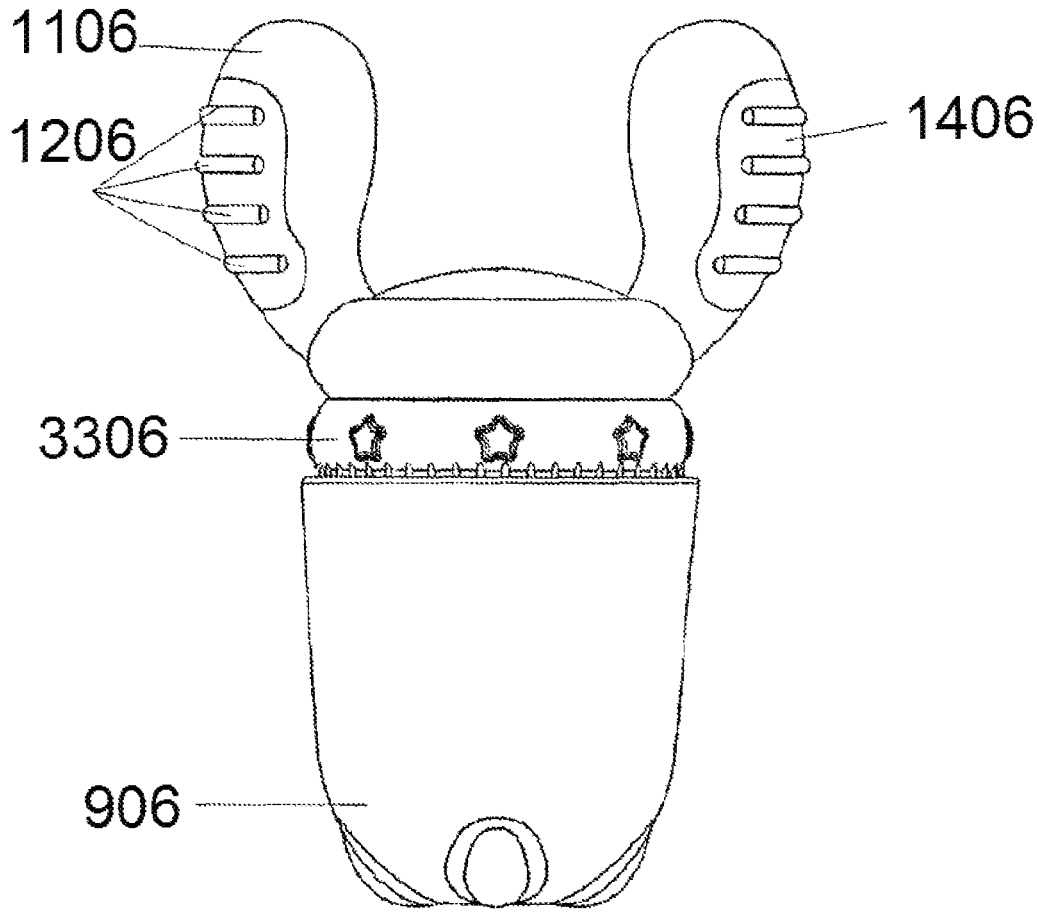
FIG. 10 is a perspective view of the sixth embodiment of the feeding apparatus.

The feed apparatus of the present application may include one handle assembly or two handle assemblies. As shown in FIGS. 9 and 10, the handle assembly of the feeding apparatus may include a handle core 1306, a handle pad 1406 and a handle sleeve 1106. The handle core 1306 can be attached to the second coupling member 306. The handle pad 1406 can be fixed on the handle core 1306 to provide anti-slip and appealing effects. According to the illustrated embodiment, two handle pads 1406 are attached to the front and the back of the handle core 1306 respectively. Alternatively, the two handle pads 1406 may be attached to the left side and the right side of the handle core 1306 respectively. The handle sleeve 1106 can be wrapped around the handle pad 1406. The handle assembly may further include a plurality of anti-slip strips 1206. The strips 1206 may be secured onto the handle pads 1406 to further provide anti-slip and appealing effects. It is understood that the number of strips 1206 on a handle pad 1406 may vary depending on the different designs. The handle sleeve 1106 and the strips 1206 may be made of soft rubber or any other suitable material, which can facilitate the gripping of the handle assembly and produce a comfort feeling to a person holding the handle assembly. The handle core 1306 and the handle pad 1406 may be made of hard plastic or any other suitable material.

Figure 11:
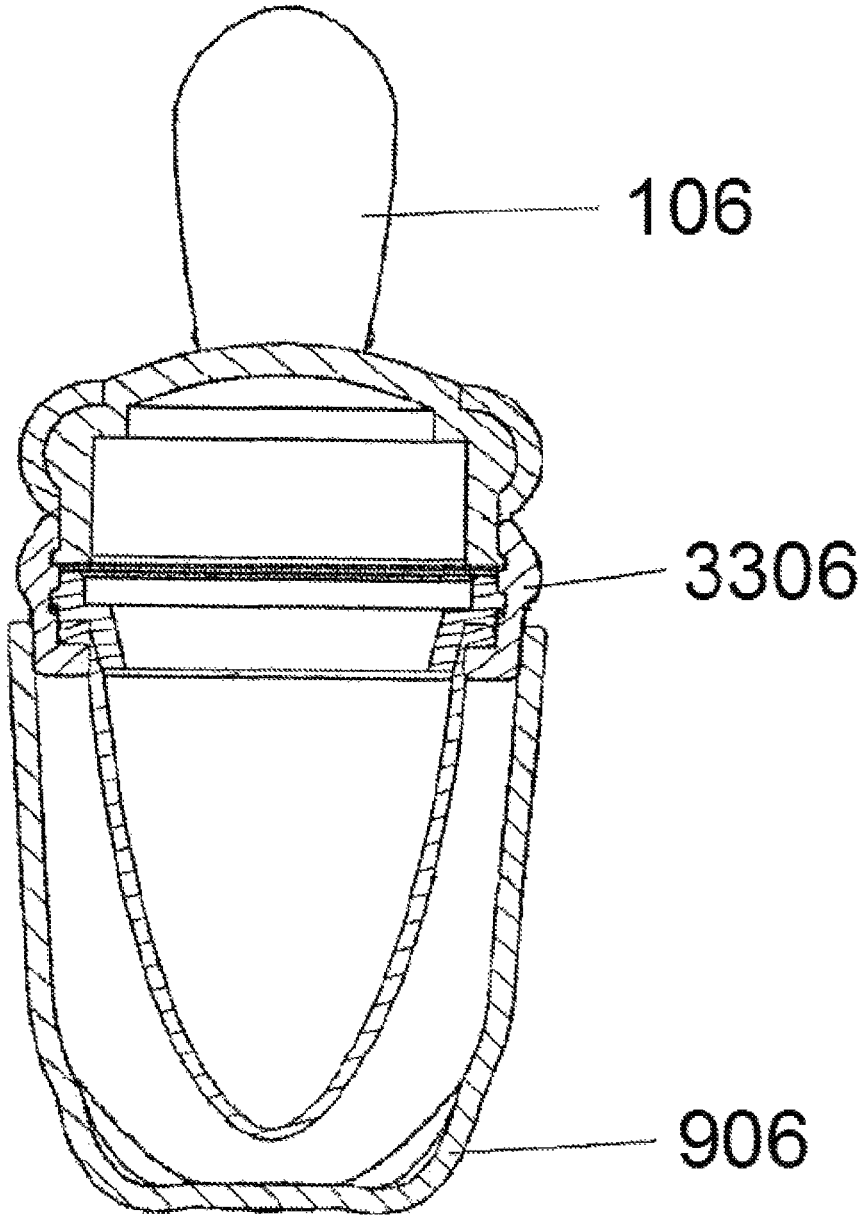
FIG. 11 is a cross sectional view taken along line A-A of the feeding apparatus in FIG. 10.

As shown in FIGS. 9-11, the second coupling member may include an outer ring 3306 and a cover 3106 covering the top of the outer ring 3306. The outer ring 3306 and the cover 3106 may be coupled together by relative rotation of a projection and recess mechanism. For example, the projection and recess mechanism may include an annular groove and an annular projection formed on the outer ring 3306 and the cover 3106 respectively. The outer ring 3306 and the cover 3106 may also be coupled together by screw threads. Alternatively, the outer ring 3306 and the cover 3106 may be integrally formed as one single piece. Two handle cores 1306 may be attached to the two sides of the cover 3106 respectively. Furthermore, the cap 906 can be coupled to the outer ring 3306.

As shown in the embodiment in FIGS. 3 and 5, a radially outwardly extending annular flange 7303, 7304 is provided at the open end 7103, 7104 of the food container 703, 704. In the sealed configuration, the annular flange 7303, 7304 rests on a radially inwardly extending annular shoulder or platform 5403, 5404 of the first coupling member 503, 504, and can be clamped between the annular platform 5403, 5404 and the second coupling member 303, 304. In the open configuration, the annular flange 7303, 7304 can be removed from the annular platform 5403, 5404 of the first coupling member 503, 504. This can make the assembling and cleaning of the feeding apparatus simple and easy. Since the food container 703, 704 is made of a soft resilient material, the soft resilient annular flange 7303, 7304 can have a sealing function and can strengthen the sealing between the first and the second coupling members 503, 504, 303, 304. This can further prevent the spilling of food while a person, especially a baby, is playing with the feeding apparatus while eating.

Figure 12:
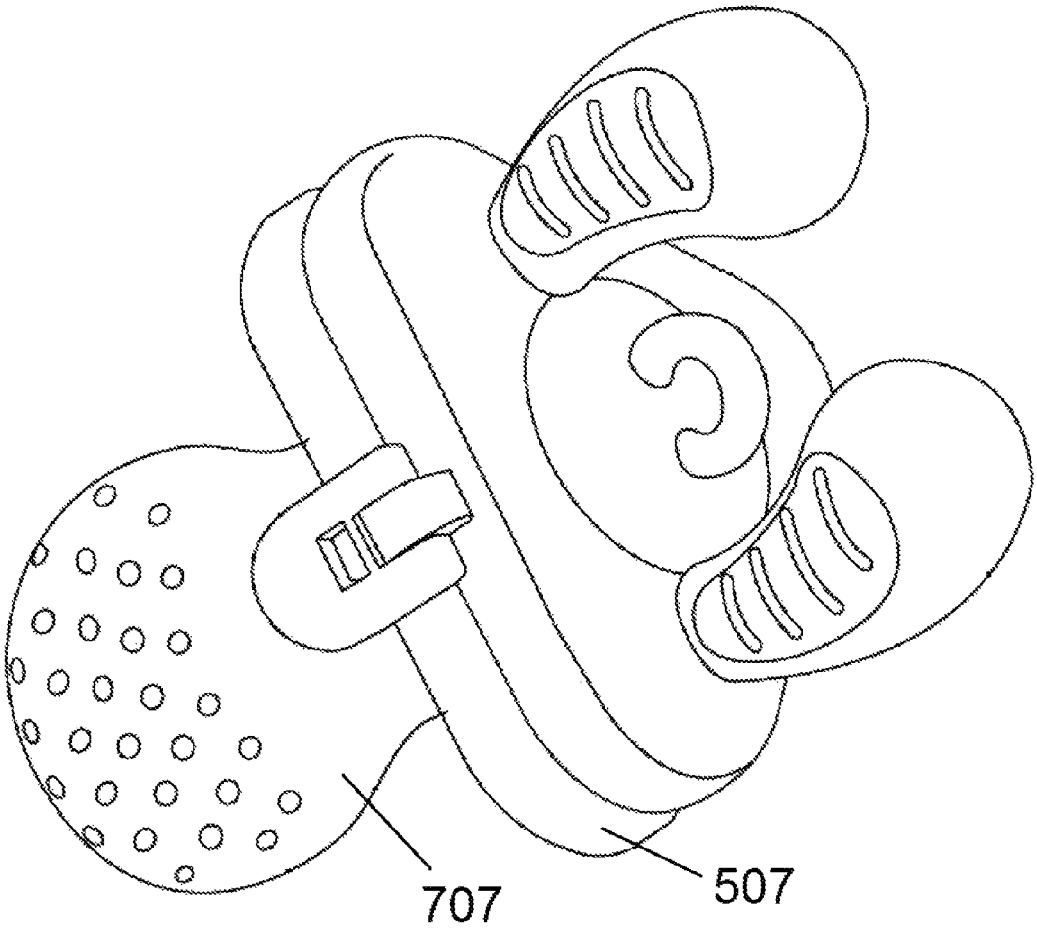
FIG. 12 is a perspective view of the seventh embodiment of the feeding apparatus.
Figure 13:
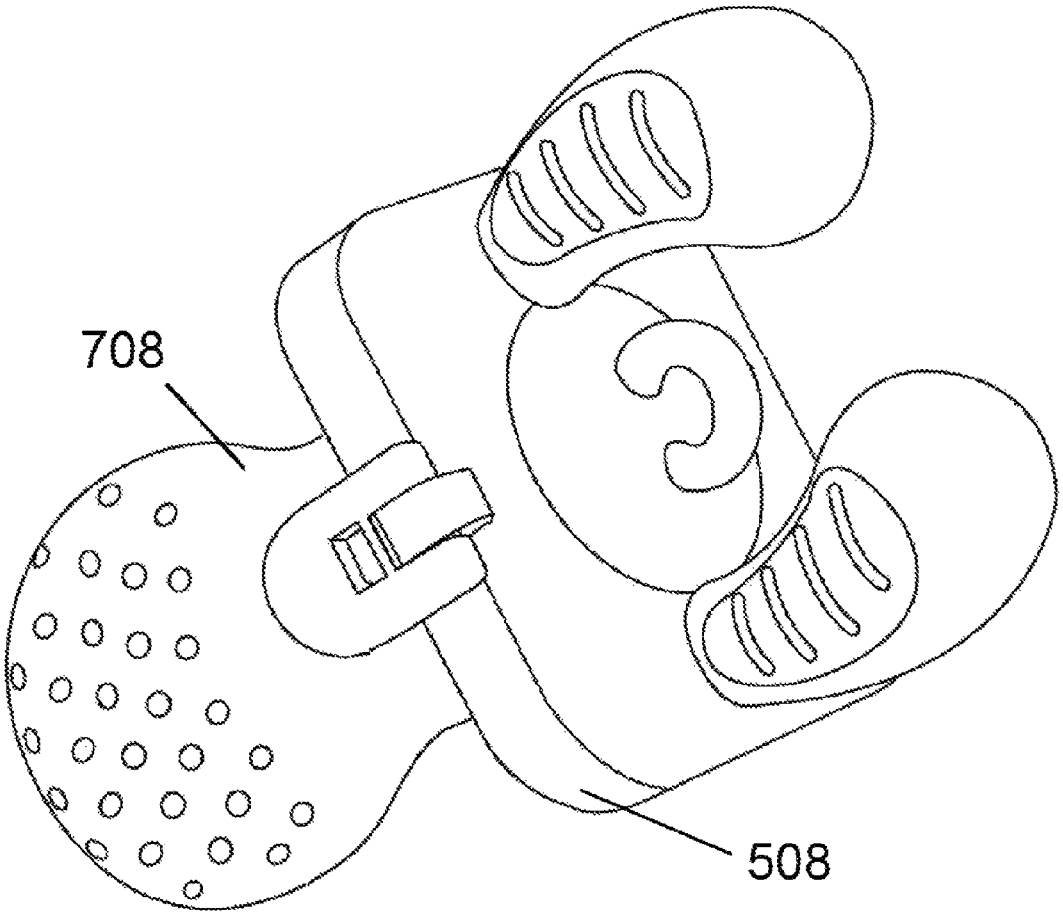
FIG. 13 is a perspective view of the eighth embodiment of the feeding apparatus.

As shown in FIG. 12, the open end of the food container 707 and the first coupling member 507 can be generally triangular in shape. Each of the three acute angles can be rounded. As shown in FIG. 13, the open end of the food container 708 and the first coupling member 508 can be generally rectangular in shape. Each of the angles can be rounded. These two feeding apparatus designs do not have unhygienic dead corners that would cause hygiene problem and are therefore easy to clean.

Figure 14:
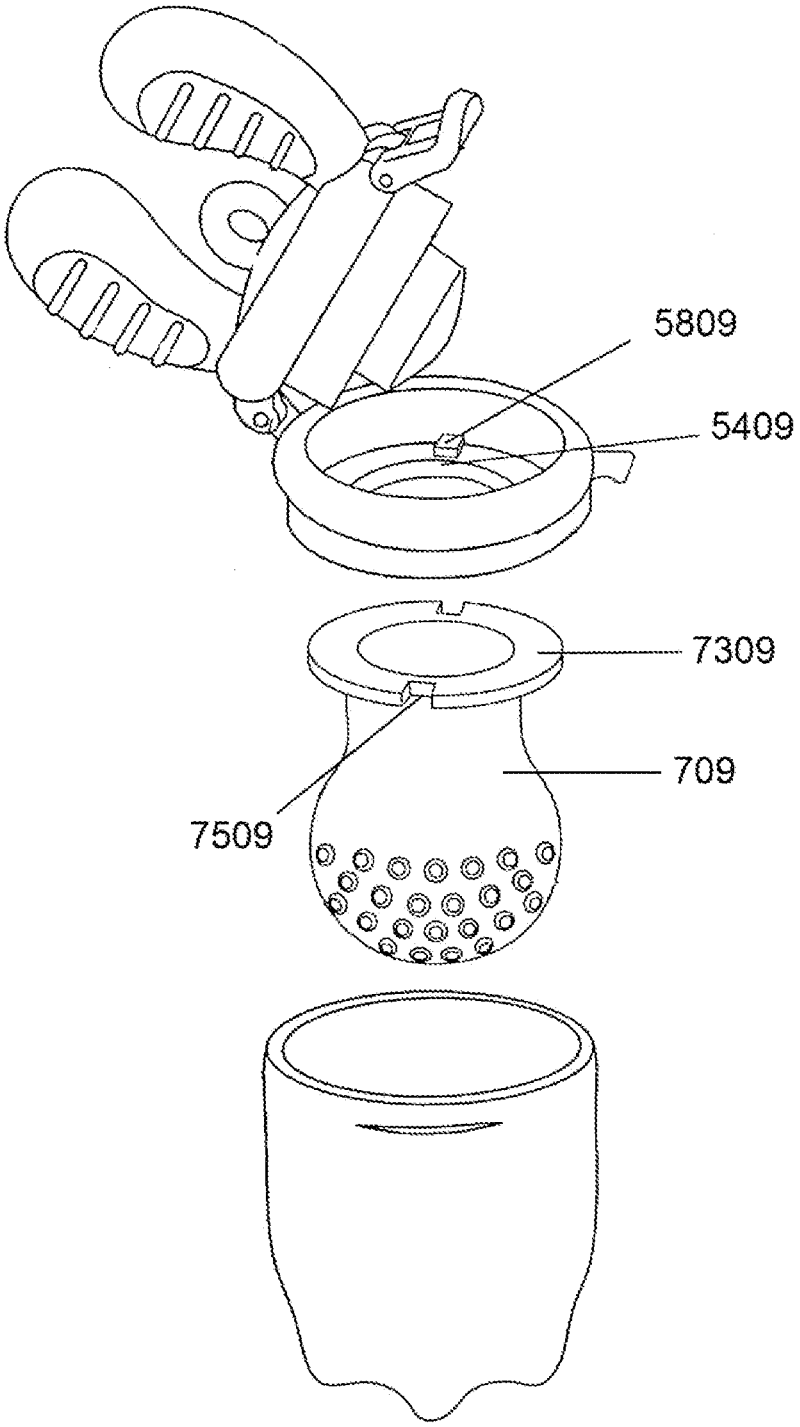
FIG. 14 is a perspective view of the ninth embodiment of the feeding apparatus.
Figure 15:
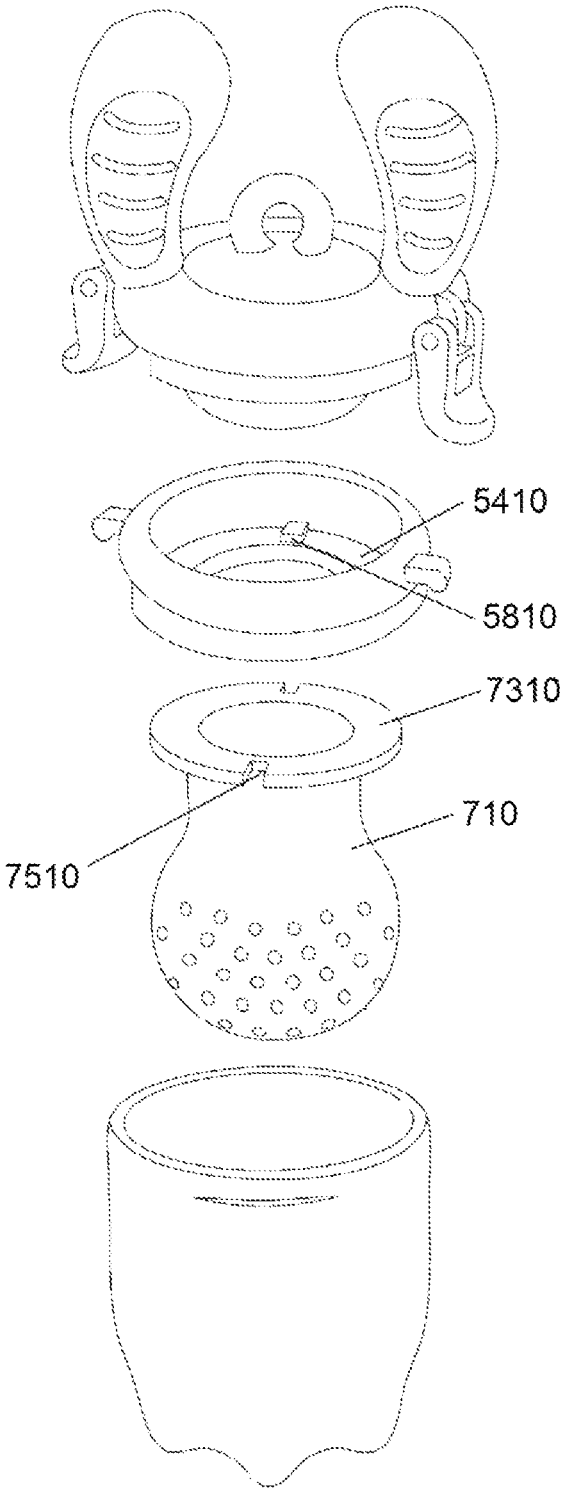
FIG. 15 is a perspective view of the tenth embodiment of the feeding apparatus.

As depicted in FIGS. 14 and 15, the position of the annular flange 7309, 7310 and the annular platform 5409, 5410 can be fixed by position-fixing mechanism thereby allowing a person to hold the handle by a hand in a horizontal position while the food container 709, 710 is in the mouth. This allows the person to hold the handle comfortably while eating. According to the illustrated embodiment, the position-fixing mechanism may include a notch 7509, 7510 provided on the annular flange 7309, 7310 and a corresponding projection 5809, 5810 provided on the annular platform 5409, 5410. Of course, it is appreciated that a notch can be formed on the annular platform 5409, 5410 and a corresponding projection can be formed on the annular flange 7309, 7310 instead.

Figure 17:
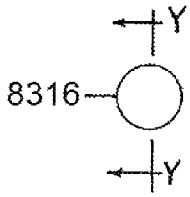
FIG. 17 is a top plan view of a projection provided on the food container.
Figure 18:
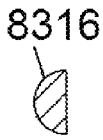
FIG. 18 is a cross sectional view taken along line Y-Y of the projection in FIG. 17.
Figure 16:
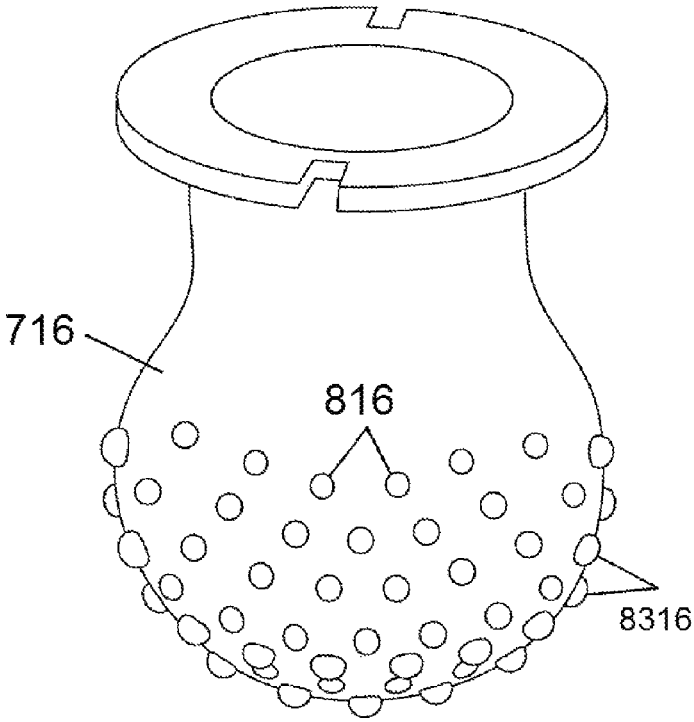
FIG. 16 is a perspective view of a food container with apertures and projections.

Although it has been shown and described that the annular protrusions 8105 are formed around the apertures 805', it is understood by one skilled in the art that further protrusions can be formed elsewhere on the outer surface of the food container 705. FIG. 16 shows a food container 716 having a plurality of apertures 816 formed around the food container 716 and a plurality of protrusions 8316 integrally formed at the closed end of the food container 716. The apertures 816 are used for dispensing food and the protrusions 8316 are used for massaging the gum of a baby or infant. According to the illustrated embodiment as shown in FIGS. 17 and 18, the protrusions 8316 are in the shape of a semi-circle. It is understood that the shape, size, and arrangement of these protrusions 8316 on the food container 716 may vary depending on different designs.

Although it has been shown and described that the apertures 816 and 805' are circular in shape, it is understood that the apertures 816 and 805' may in any other appropriate shapes.

While the feeding apparatus disclosed in the present application has been shown and described with particular references to a number of preferred embodiments thereof, it should be noted that various other changes or modifications may be made without departing from the scope of the appending claims.

What is claimed is:

1. A feeding apparatus comprising:

a food container comprising an open end, a closed end, and at least one aperture;

a first coupling member comprising a platform, and an opening in communication with the container open end, the food container being engaged with the first coupling member; and a second coupling member cooperating with the first coupling member and movable between an open configuration allowing food to pass through the opening and into the food container, and a sealed configuration where the second coupling member covers the opening of the first coupling member thereby sealing the open end of the food container, the second coupling member comprising a first protruding plug portion which snugly plugs into and seals the opening of the first coupling member when the second coupling member is in the sealed configuration;

wherein the open end of the food container comprises an flange which is adapted to be clamped between the platform of the first coupling member and the first protruding plug portion of the second coupling member, a bottom surface of the first protruding plug portion is pressed against a top surface of the flange of the food container, and a bottom surface of the flange of the food container is pressed against the platform of the first coupling member when the second coupling member is in the sealed configuration;

wherein the flange comprises a shaped notch disposed on a edge thereof for engagement with an axially protruded projection of corresponding shape disposed on the platform; and wherein the food container is made of a soft resilient material, and the at least one aperture and the food container are sized and shaped such that normally the food container stays in its original shape and the food stays inside the food container, and wherein the food container while in a person's mouth collapses by external force that forces the food to pass through the at least one aperture, and the food container returns to its original shape upon release of the force.

2. The feeding apparatus as claimed in claim 1, wherein the second coupling member further comprises a second protruding plug portion extending from the first plug portion, the second protruding plug portion snugly plugs into and seals the open end of the food container when the second coupling member is in the sealed configuration.

3. The feeding apparatus as claimed in claim 1, further comprising a cap for covering the food container, and a plurality of supporting elements is provided on the cap.

4. The feeding apparatus as claimed in claim 1, the first and second coupling members are fastened together at two sides thereof by two fasteners respectively.

5. The feeding apparatus as claimed in claim 1, wherein the first and second coupling members are hingedly connected together at one side and fastened together at another side.

6. The feeding apparatus as claimed in claim 1, wherein the open end of the food container and the platform of the first coupling member are in an annular shape.

7. The feeding apparatus as claimed in claim 1, further comprising at least one fastening mechanism for fastening the first and second coupling members together while in the sealed configuration.

* * * * *